US005092475A

United States Patent [19]

Krishnakumar et al.

[11] Patent Number: 5,092,475

[45] Date of Patent: Mar. 3, 1992

[54] REINFORCED AND PANELED HOT FILL CONTAINER

[75] Inventors: Suppayan M. Krishnakumar, Nashua; Wayne N. Collette, Merrimack; David P. Piccioli, Auburn, all of N.H.

[73] Assignee: Continental PET Technologies, Inc., Florence, Ky.

[21] Appl. No.: 723,333

[22] Filed: Jun. 28, 1991

[51] Int. Cl.[5] ..... B65D 73/00; B65D 1/42

[52] U.S. Cl. ..... 215/1 C; D9/394; D9/398

[58] Field of Search ..... 215/1 C; 220/666, 669, 220/671, 674, 675; D9/370, 391, 392, 394, 395, 396, 397, 398, 410; 40/310, 638

[56] References Cited

U.S. PATENT DOCUMENTS

| | | | |
|---|---|---|---|
| D. 74,274 | 1/1928 | Root | D9/398 X |
| D. 262,521 | 1/1982 | Frahm et al. | D9/394 |
| D. 295,382 | 4/1988 | Rogler | D9/392 |
| 3,871,541 | 3/1975 | Adomaitis | 215/1 C |
| 4,421,804 | 12/1983 | Mori et al. | 215/1 C X |
| 4,804,097 | 2/1989 | Alberghini et al. | 215/100 A |
| 4,818,575 | 4/1989 | Hirata et al. | 215/1 C X |
| 4,863,046 | 9/1989 | Collette et al. | 215/1 C |
| 4,865,211 | 9/1989 | Hollingsworth | 215/1 C X |
| 4,877,141 | 10/1989 | Hayashi et al. | 215/1 C |
| 5,005,716 | 4/1991 | Eberle | 215/1 C |

*Primary Examiner*—Stephen P. Garbe
*Assistant Examiner*—Vanessa Caretto
*Attorney, Agent, or Firm*—Charles E. Brown

[57] ABSTRACT

A blow molded polyester container of the type specifically constructed for filling with a hot product and including a generally cylindrical body with the body having a major portion thereof of a reduced diameter and defining a label receiving area. The label receiving area has formed therein a series of circumferentially spaced expansion panels extending a major part of the height of the label receiving area and being separated by vertically extending reinforcing ribs that are spaced from adjacent expansion panels. Most specifically, the vertically extending reinforcing ribs have now been made of a height greater than the height of the expansion panels and undesirable bulges which previously appeared at the ends of similar reinforcing ribs when the ribs were shorter than the expansion panels have been eliminated.

3 Claims, 1 Drawing Sheet

REINFORCED AND PANELED HOT FILL CONTAINER

This invention relates in general to new and useful improvements in hot fill containers, and more particularly to a specific reinforcement for a hot fill container.

BACKGROUND OF THE INVENTION

There is in existence a blow molded polyester container of the type specifically constructed for filling with a hot product. Such a container has a generally cylindrical body with a major portion of that body being in the form of a label receiving portion and wherein the label receiving portion is provided with a plurality of circumferentially spaced expansion panels having therebetween a vertical reinforcing rib. While the container otherwise performs satisfactorily, it has been found that unexpectedly there is a deformation of the container body within the label receiving portion thereof at the ends of the reinforcing rib. Why this distortion occurs is not clear.

SUMMARY OF THE INVENTION

Notwithstanding the foregoing, it has been found that if the vertical reinforcing rib between the adjacent expansion panels is elongated from its original length which is shorter than the height of the expansion panels, to a length wherein it is longer than the height of the expansion panels, the distortion is reduced and if the vertical ribs are lengthened to extend the full height of the label receiving portion of the container, the distortion is fully eliminated.

With the above and other objects in view that will hereinafter appear, the nature of the invention will be more clearly understood by reference to the following detailed description, the appended claims, and the several views illustrated in the accompanying drawings.

DESCRIPTION OF THE PRIOR ART

Figure 1:
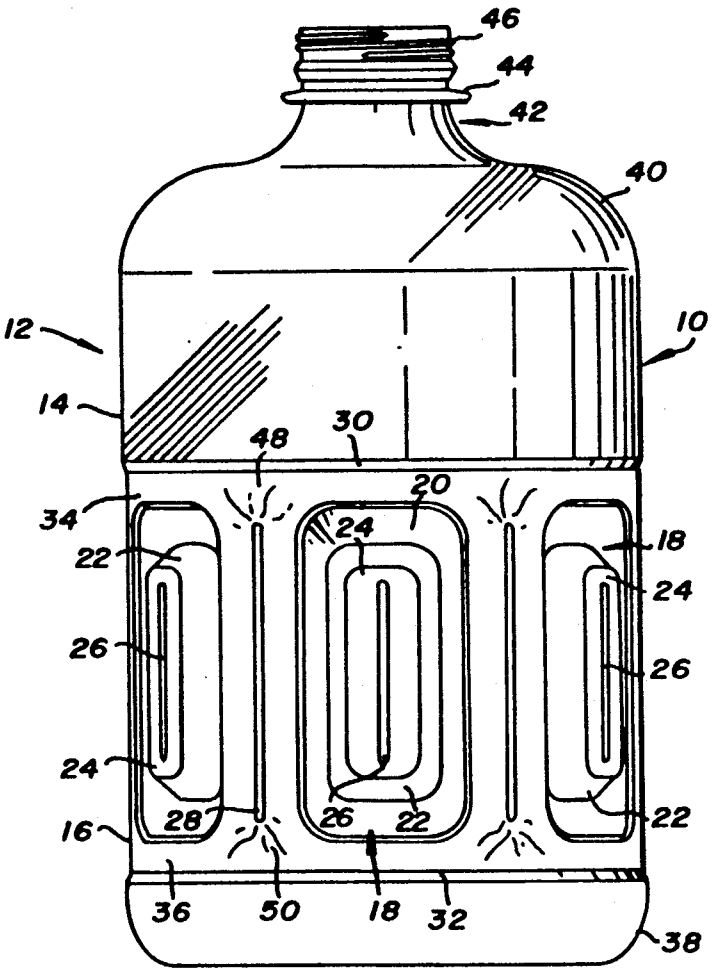
FIG. 1 PRIOR ART
FIG. 1 is an elevational view of a prior art container which has been improved in accordance with this invention and wherein the vertical reinforcing ribs are shorter than the collapsible panels.

Referring first to FIG. 1, it will be seen that there is illustrated the prior art container which is generally identified by the numeral 10. The numeral 10 includes a generally cylindrical body identified by the numeral 12 which has an upper portion 14 which is plain and which is of a selected maximum diameter. The body 12 includes a lower portion which is generally cylindrical, but of a lesser diameter than the portion 14. This lower portion defines a label receiving area and is reinforced. The reinforcement includes a plurality of circumferentially spaced collapsible panels 18. Each panel 18 includes a radially inwardly offset peripheral portion 20 from which there projects in a radial direction a central boss portion 22. The boss portion 22 in turn includes an outer panel 24 which is reinforced by a radially inwardly extending, vertical rib 26.

Between each of the collapsible panels 18 is a vertically extending, inwardly projecting rib 28. These ribs have been of a height less than the height of the panels 18 and have provided satisfactory reinforcement against the collapse of the label receiving area 16.

More particularly, the label receiving area 16 is defined at the top by a small offset shoulder 30 and at the bottom by a small offset shoulder 32 with the portions of the label receiving area 16 adjacent the shoulders 30, 32 as at 34, 36, respectively, being smooth.

The container 10 also receives a suitable base 38 below the shoulder 32 and a shoulder 40 above the cylindrical portion 14 converging into a neck finish generally identified by the numeral 42. A major part of the neck finish 42, at least starting with a supporting flange 44, is free of blow molding expansion and is in as injection molded state. This includes an upper external thread portion 46.

It has been found that under certain conditions, particularly when an effort is made to lightweight the container 10, the smooth label receiving areas 34, 36 become puckered as at 48 and 50 above and below each vertical reinforcing rib 28, respectively.

DESCRIPTION OF THE INVENTION

Figure 2:
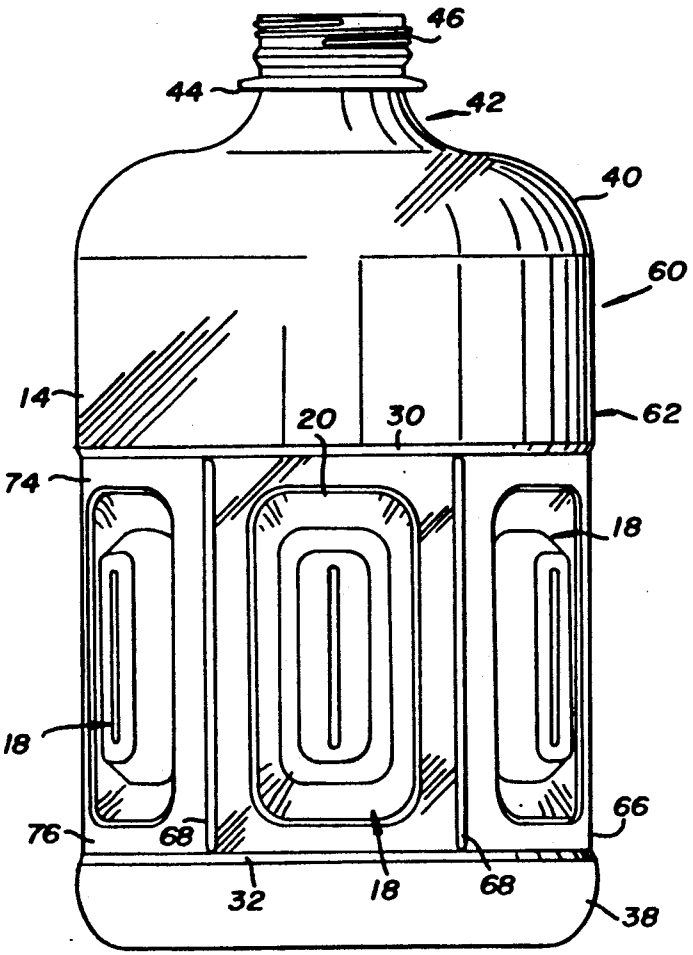
FIG. 2 is an elevational view similar to FIG. 1 of a container improved in accordance with this invention wherein the reinforcing ribs have been extended the full height of the label receiving portion of the container body.

Referring now to FIG. 2, it will be seen that there is illustrated a container which is generally identified by the numeral 60. The container 60, for the most part, is identical to the container 10 and includes a body 62 which differs from the body 12 only in a label receiving area 66 which differs from the label receiving area 16 of the container 10. Most particularly, it will be seen that the container 60 differs from the container 10 only in that the reinforcing ribs 28 of the container 10 have been replaced by reinforcing ribs 68 which instead of having a height less than the height of the panels 18 as in the case of the reinforcing ribs 28, have a height which is greater than that of the collapsible panels 18. The reinforcing ribs 68 have been specifically illustrated as extending fully between the shoulders 30, 32 and thus interrupting that which were the previously designated smooth areas 34, 36 of the container 10. These interrupted areas are now identified by the numerals 74, 76.

It has been found that by modifying the container 10 to have the configuration of the container 60, i.e. by increasing the length of the vertical reinforcing ribs from that of the ribs 28 to that of the ribs 68, the deformations 48, 50 which previously occurred at the ends of the ribs 28, are eliminated.

Inasmuch as the ribs 68 are radially inwardly offset, even though they traverse the previously smooth and continuous areas 34, 36 to which a label is bonded, satisfactory bonding of a label (not shown) to the areas 74, 76 is possible.

Thus merely by lengthening the vertical reinforcing ribs, an unobvious improvement in the form of the elimination of the deformations 48, 50 is obtained.

Although only a preferred embodiment of the invention has been specifically illustrated and described herein, minor variations may be made in the length of the reinforcing ribs 68 within the scope of the invention as defined by the appended claims.

I claim:

1. A blow molded polyester container of the type specifically constructed for filling with a hot product and including a generally cylindrical body, said body having a major portion thereof of a reduced diameter and defining a label receiving area, said reduced diameter major portion having formed therein a series of circumferentially spaced expansion panels extending a major part of the height of said major portion and being separated by vertically extending reinforcing ribs each being spaced from adjacent expansion panels, the container being improved by said reinforcing ribs extending vertically above and below adjacent ones of said expansion panels.

2. A blow molded container according to claim 1 wherein each of said reinforcing ribs extend substantially the full height of said label receiving area.

3. A blow molded container according to claim 1 wherein each of said reinforcing ribs extend the full height of said label receiving area.

* * * * *